United States Patent [19]

Peters

[11] 4,438,964

[45] Mar. 27, 1984

[54] PADDLE OPERATED VEHICLE LATCH

[75] Inventor: William S. Peters, Appleton, Wis.

[73] Assignee: Pierce Manufacturing, Inc., Appleton, Wis.

[21] Appl. No.: 275,006

[22] Filed: Jun. 18, 1981

[51] Int. Cl.[3] ..... E05C 3/26; E05B 13/10

[52] U.S. Cl. ..... 292/216; 70/149; 70/208; 292/173; 292/207; 292/217; 292/DIG. 31

[58] Field of Search ..... 292/280, 216, DIG. 31, 292/217, 229, 214, 213, 207, 165, 173; 70/208, 70/149

[56] References Cited

U.S. PATENT DOCUMENTS

| | | | |
|---|---|---|---|
| 157,668 | 12/1874 | Allen et al. | 292/173 |
| 2,634,147 | 4/1953 | Robertson | 292/229 X |
| 2,668,076 | 2/1954 | Troche et al. | 292/DIG. 31 X |
| 2,676,047 | 4/1954 | Gould | 292/229 |
| 2,767,007 | 6/1953 | Burke | 292/229 X |
| 3,668,907 | 6/1972 | Pastva | 292/DIG. 31 X |
| 3,709,537 | 1/1973 | Kazaoka et al. | 292/216 |
| 3,767,243 | 10/1973 | Yoshimura | 292/216 |

FOREIGN PATENT DOCUMENTS

| | | | |
|---|---|---|---|
| 828167 | 2/1960 | United Kingdom | 292/216 |
| 1278129 | 6/1972 | United Kingdom | 292/216 |

*Primary Examiner*—Gary L. Smith
*Assistant Examiner*—R. Illich
*Attorney, Agent, or Firm*—Allan B. Wheeler

[57] ABSTRACT

A rotary latch mechanism for engaging a latch post, for example to latch a vehicle door to its frame. The latch mechanism comprises a rotating cam having a recess to engage or release the latch post. A torsion spring or the like biases the cam for rotation toward the position in which it releases the latch post. A latch bar sliding perpendicular to the plane of rotation of the cam is biased for slidably engaging an abutment on the cam to latch the cam in its engaged position. A handle or other release is provided to retract the latch bar, freeing the cam for rotation to its disengaged position. The mechanism is quite simple and requires only a few moving parts, yet it provides the same functions as other more complex latch mechanisms.

10 Claims, 11 Drawing Figures

Fig. 4
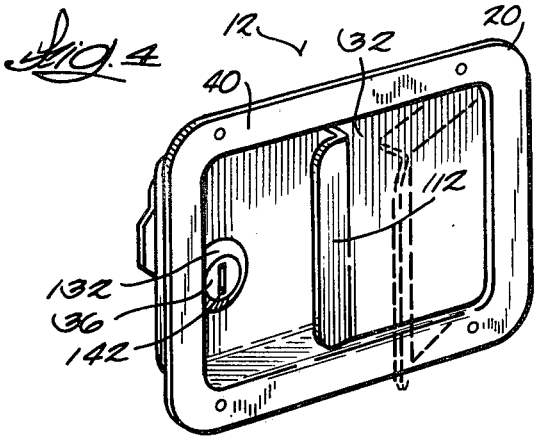
Fig. 10
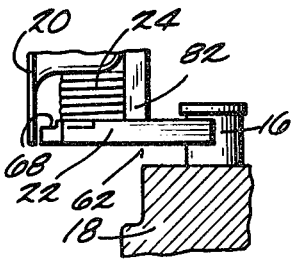
Fig. 9
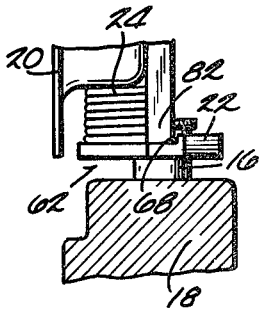
Fig. 1
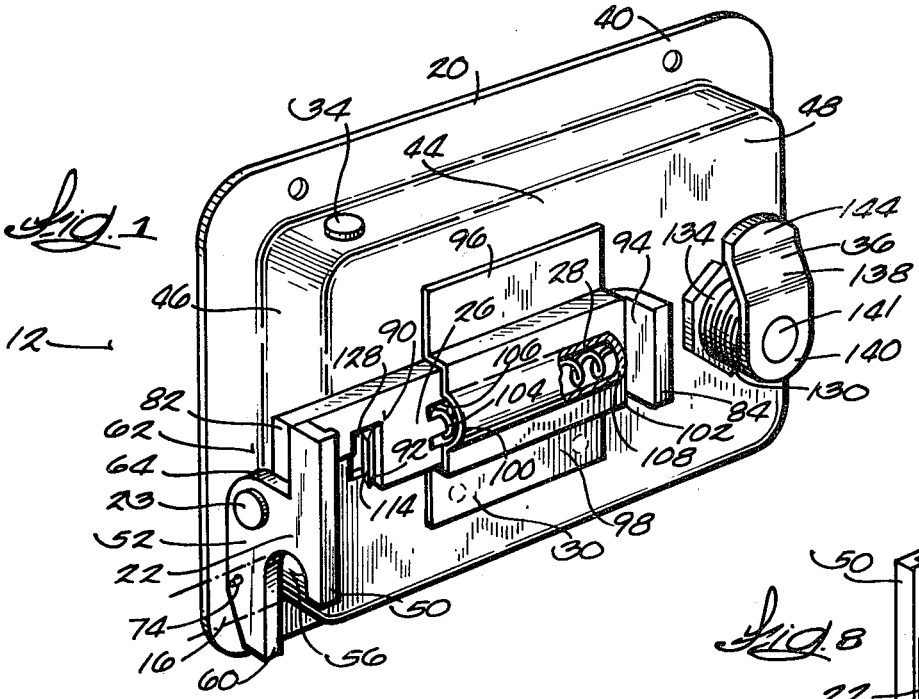
Fig. 8
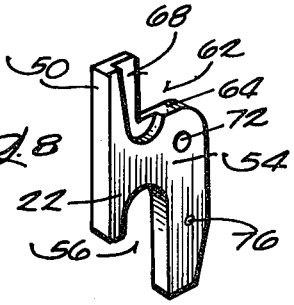
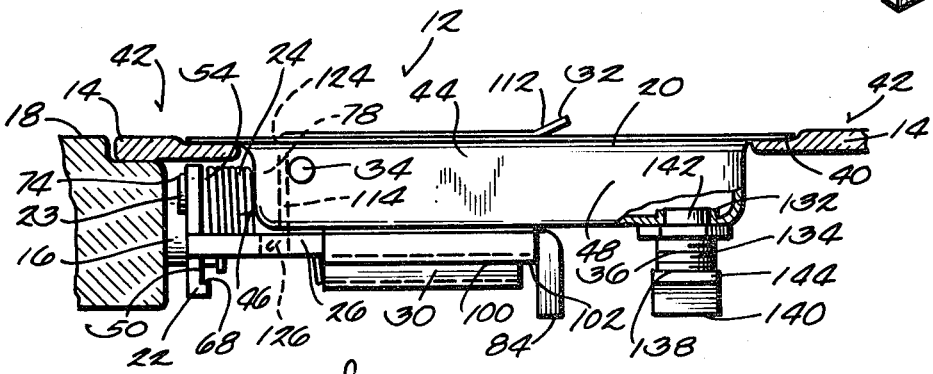
Fig. 2.

PADDLE OPERATED VEHICLE LATCH

TECHNICAL FIELD

The present invention relates to mechanisms for latching a door to a latch post mounted on the door frame. Such latches are particularly used for latching a vehicle door.

BACKGROUND ART

Latch mechanisms having a door mounted cam which rotates to engage or disengage a latch post are well known, particularly for latching vehicle doors. Such latches typically include many moving parts to provide latched, safety latched, unlatched, and locked positions. The typical latch mechanism thus is relatively expensive to build and has many parts which can fail.

SUMMARY OF THE INVENTION

The present invention is a latch mechanism which is more simply constructed and has fewer moving parts than known latching mechanisms but performs all the functions of the known mechanisms. The mechanism comprises a cam pivotally mounted at the edge of a door and having a recess to rotatably engage and disengage a latch post mounted to the door frame. The positions of the cam and the latch post can also be exchanged within the scope of the present invention. The cam is biased to normally rotate to its disengaged position, and to rotate against that bias to its engaged position when the latch post is received in the recess as the door is closed. A latch bar sliding perpendicular to the plane of the cam and biased to extend through that plane rests with one end abutting the cam face when the latch is disengaged. When the cam is rotated to its engaged position, the latch bar is released and moves responsive to its bias to an extended position engaging an abutment on the cam to latch the cam. The latch bar can be retracted against its bias to release the cam for rotation to a disengaged position so the door can be opened.

BRIEF DESCRIPTION OF DRAWINGS

FIG. 1 is a perspective view of the latch mechanism, seen from behind.

FIG. 2 is a plan view of the mechanism of FIG. 1, shown in the context of a door and frame.

FIG. 4 is a front perspective view of the latch mechanism of FIG. 1.

FIG. 8 is a reversed perspective view of the cam shown in FIG. 3.

FIG. 9 is a fragmentary plan view of the structure shown in FIG. 6.

FIG. 10 is a fragmentary plan view of the structure shown in FIG. 7.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 3:
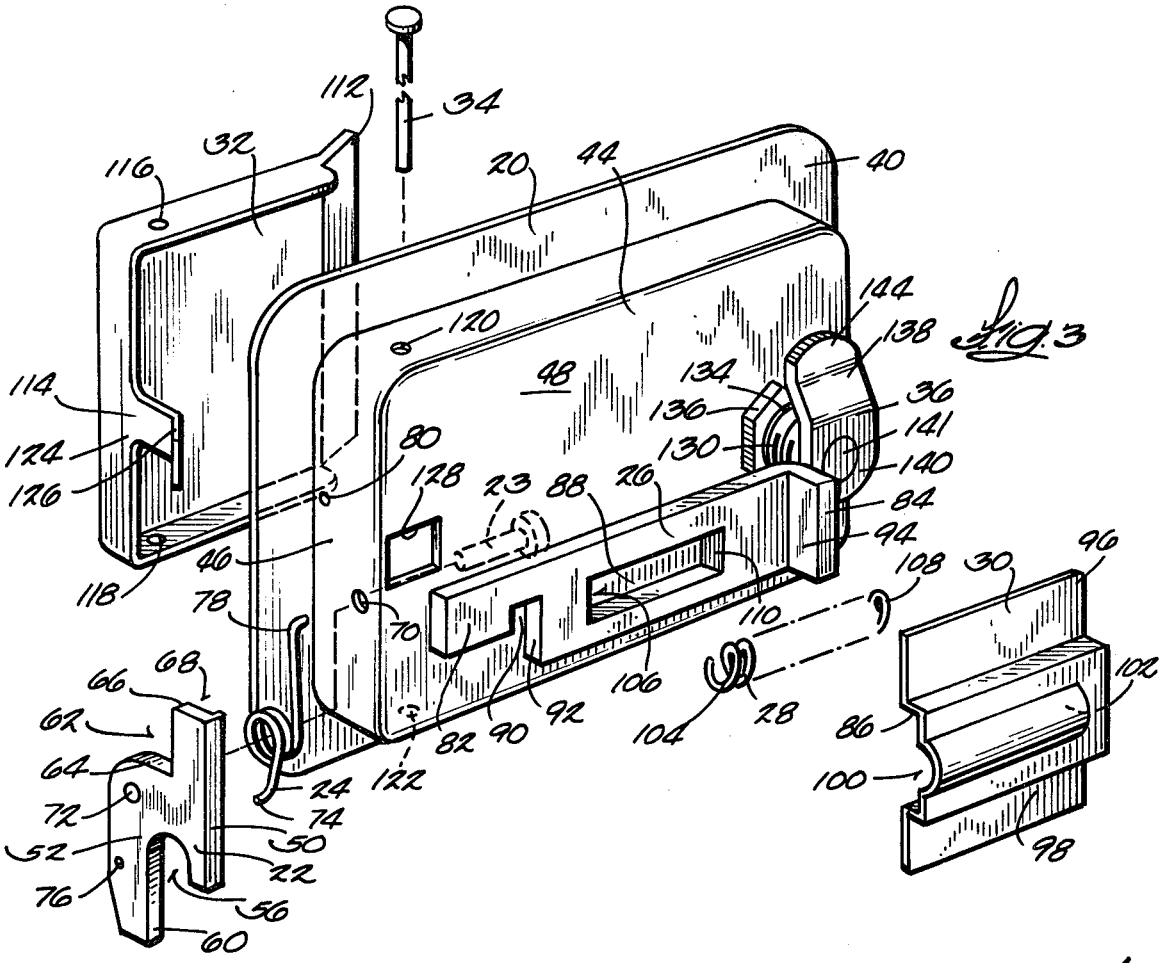
FIG. 3 is an exploded perspective view of the mechanism shown in FIG. 1.

FIGS. 1, 2, and 3 show the parts and layout of a rotary latch mechanism 12 for mounting in a door 14 to engage a latch post 16 extending from an adjacent door frame member 18. In an alternate embodiment of the invention, the latch post 16 could be mounted to door 14 and the latch mechanism 12 could be mounted to the frame member 18.

The latch mechanism 12 generally comprises a latch frame 20 to which the other elements are attached, a cam 22, a pivot pin 23 to attach cam 22 to latch frame 20, a torsion spring 24 connecting cam 22 to frame 20 to bias the cam for rotation, a latch bar 26, a compression spring 28 to bias latch bar 26 for sliding, a bracket 30 for attachment to latch frame 20 to enclose spring 28 and confine the motion of latch bar 26 to longitudinal sliding, a paddle handle 32 attached to latch frame 20 by pivot pin 34 and used to unlatch the mechanism, and lock means 36 to allow the latch to be locked against disengagement of latch post 16.

Latch frame 20 has a peripheral flange 40 for attachment to the outer surface 42 of door 14 and a recessed central portion 44 extending through outer surface 42 to position mechanism 12 within the door. Wall 46 of recessed portion 44 defines an outer edge of the latch frame. All of the elements of latch mechanism 12 except handle 32 are mounted on the inside surface 48 of latch frame 20.

Cam 22 is the focal point of latch mechanism 12, as it engages latch post 16 to latch the door and releases latch post 16 to unlatch the door. Cam 22 has a peripheral edge 50 and opposed faces 52 and 54. Edge 50 includes a first recess 56 defined by leading and following edges 58 and 60 and a second recess 62 defined by leading and following edges 64 and 66. Referring briefly to FIG. 8, cam face 54 is inwardly stepped (68) adjacent to the abutment defined by following edge 66. Cam 22 is pivotally mounted on wall 46 by pivot pin or rivet 23 which passes through apertures 70 and 72 and is suitably secured in place. FIG. 2 illustrates that the space between cam face 54 and wall 46 is filled by the coiled portion of torsion spring 24, preventing axial play of cam 22 on pivot pin 23 when the latch mechanism is assembled.

Figures 5, 6, 7:
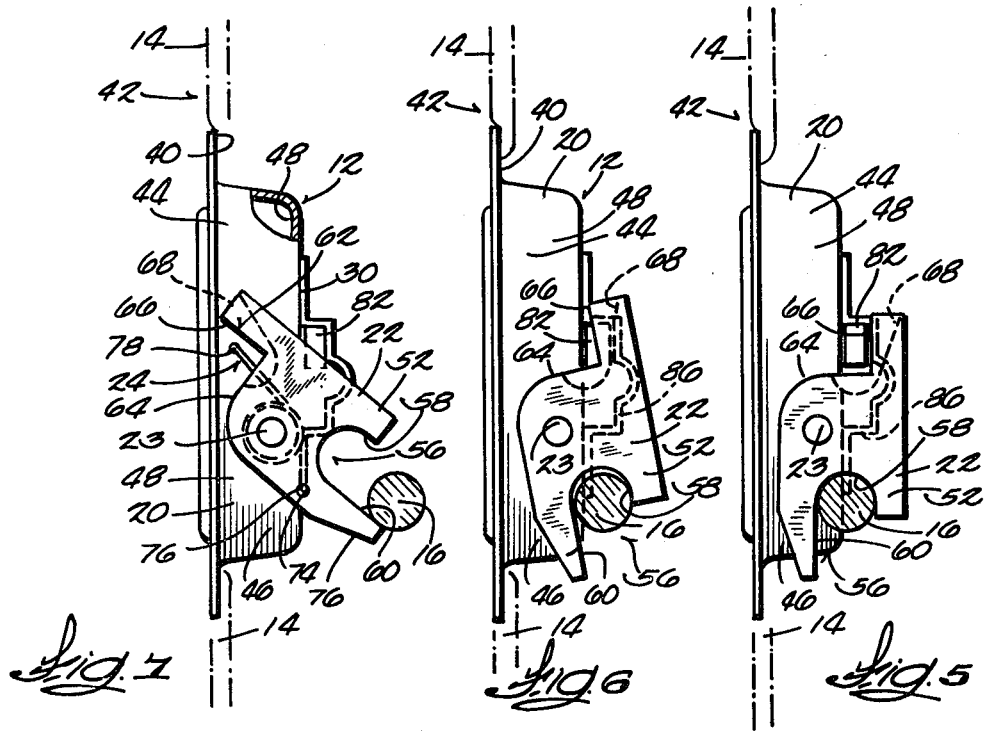
FIGS. 5, 6 and 7 are side elevations of the mechanism of FIG. 1 mounted on a door, respectively showing the cam in its engaged, safety, and disengaged positions.

Torsion spring 24 has a first end 74 received in aperture 76 of the cam and a second end 78 received in aperture 80 of wall 46 to bias cam 22 for rotation to the position shown in FIG. 7, in which torsion spring 24 exerts no tension. Thus, when the cam is oriented as shown in FIGS. 5 and 6, spring 24 biases the cam for counterclockwise rotation. FIGS. 5, 6, and 7 respectively show the cam in an engaged position, a safety position, and a disengaged position.

Latch bar 26 has first and second ends 82 and 84 and a central portion received in a guideway 86 formed in bracket 30. Latch bar 26 further comprises a slot 88 to receive compression spring 28 and a recess or pocket 90 defined in part by a face 92 opposed to the second end 84 of the latch bar. Second end 84 includes an abutment 94 formed by bending the second end of the latch bar.

Bracket 30 comprises recessed guideway 86 flanked by first and second flanges 96 and 98 for attachment to inside surface 48 of latch frame 20. A recessed pocket 100 extends nearly the length of guideway 86, but is interrupted by the end 102 of guideway 86. When bracket 30 is attached to inside surface 48, compression spring 28 is confined in the space formed by slot 88 and pocket 100. End 104 of spring 28 bears against the shorter face 106 of slot 88 and end 108 of spring 28 bears against the inner edge of end 102 of guideway 86. Spring 28 thus biases latch bar 26 for sliding to the left in FIG. 1. The biasing means just described biases latch bar 26 for sliding to an extended position, shown in FIG. 1, wherein abutment 94 of the latch bar is against end 102 of guideway 86 and first end 82 of the latch bar extends completely through the plane of cam face 54. Latch bar 26 can also be retracted against the bias of spring 28 to an intermediate or safety position (shown in FIGS. 6 and 9) in which end 82 is lodged between the planes defining cam faces 52 and 54 and to a retracted position in which first end 82 of latch bar 26 is completely clear of cam 22.

Paddle handle 32 has a grip portion 112, a tongue 114 and apertures 116 and 118 for registration with apertures 120 and 122 within recessed portion 44 of latch frame 20 to receive pivot pin 34. Tongue 114 has a first end 124 joined to the rest of the handle and a second end 126 extending into recess 90 of latch bar 96 through an aperture 128 in the recessed portion 44 of latch frame 20.

Lock 36 comprises a casing 130 having an outer collar 132 and an inner threaded portion 134 cooperating with a nut 136 to fix casing 130 to the recessed portion 44 of latch frame 20. A locking bar 138 has a first end 140 mounted to lock cylinder 141 for rotation about an axis normal to latch bar 26 when cylinder 141 is rotated by the proper key inserted into slot 142. When locking bar 138 is in the first pivotal position shown in FIG. 1, its second end 144 is clear of second end 84 of latch bar 26. When locking bar 138 is moved to a second pivotal position using a key, its second end 144 engages second end 84 of latch bar 26 to prevent retraction of the latch bar.

The operation of latch mechanism 12 can now be described in detail. When the latch is released, as when the door is open, cam 22 is in its disengaged position, (FIGS. 7 and 10), latch bar 26 is in its retracted position (same figures), and handle 32 is confined almost completely within recessed portion 44 of latch frame 20 (FIG. 4, solid lines).

To latch door 14 it is closed, moving the attached mechanism 12 to the right with respect to latch post 16 (FIGS. 7–5, in that order). When following edge 60 of the cam first engages latch post 16, leading edge 58 of the cam is clear of the latch post. Further movement of following edge 60 into engagement with latch post 16 rotates cam 22 clockwise against the bias of torsion spring 24, allowing the first recess 56 to receive the shank of latch post 16. When the cam 22 is rotated to the safety latch position shown in FIGS. 6 and 9, first end 82 of the latch bar, previously bearing against cam face 54, advances into step 68 to advance latch bar 26 to its safety position. When the latch is in the safety position, leading edge 58 of the cam engages the shank of latch post 16 to prevent the door from being opened, but the door can be closed more completely to the position shown in FIGS. 1 and 5 to fully latch the door. A safety latch is provided so that if the door is not shut completely enough for the latch mechanism to completely latch, the door is still prevented from opening when the vehicle is moving.

When door 14 is completely closed the latch mechanism and latch post 12 and 16 are completely engaged and the door is completely shut. This is shown in FIGS. 1, 2, and 5. Cam 22 is then in its engaged position. First end 82 of latch bar 26 then completely clears the cam and is advanced to its extended position by compression spring 28. The travel of latch bar 26 is limited by second end 126 of tongue 114 extending into recess 90 of latch bar 26. First end 82 of latch bar 26 is thus behind following edge or abutment 66, latching cam 22 against rotation by spring 24.

Latch mechanism 12 is released to open the door by pulling outward on grip portion 112 of handle 32, rotating handle 32 about pivot pin 34 to the position shown in dotted lines in FIG. 4. Referring in particular to FIG. 2, this brings second end 126 of tongue 114 into engagement with face 92 of recess 90, retracting latch bar 26. It will be obvious to one of ordinary skill in the art that many other means could be used to retract latch bar 26 directly or remotely.

Latch bar 26 is retracted first to its safety position as shown in FIGS. 6 and 9, then to its completely retracted position as shown in FIGS. 7 and 10. When the latch bar is retracted, torsion spring 24 rotates cam 22 first to its safety latch position, then to its disengaged position. At this point first end 82 of latch bar 26 again bears against cam face 54, so the latch bar remains retracted until cam 22 is rotated by latch post 16 when the door is again closed.

Figure 11:
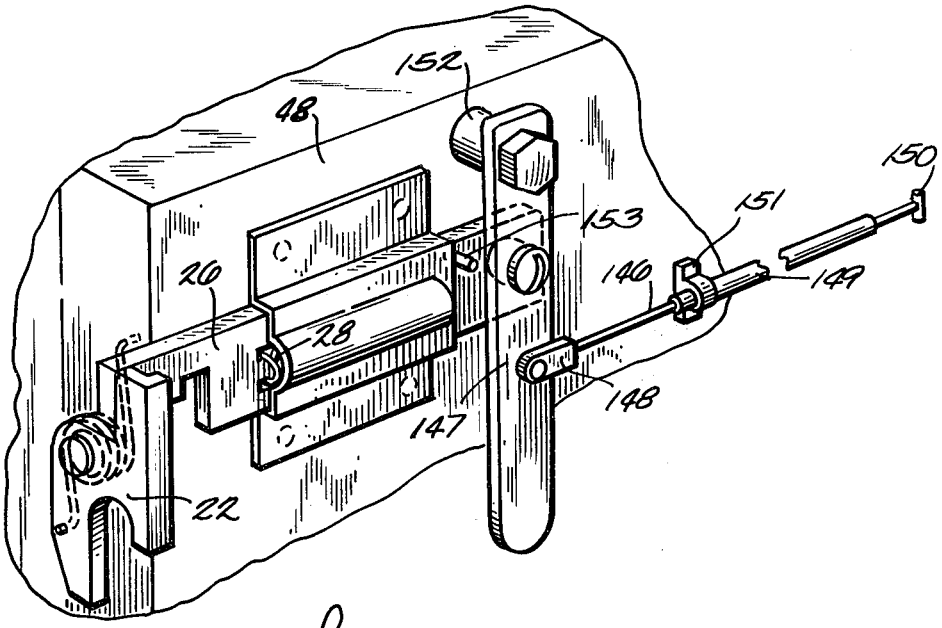
FIG. 11 is a fragmentary perspective view of an alternate embodiment of the invention in which a cable release operates the latch remotely.

An alternate embodiment of the invention, shown in FIG. 11, provides a remote cable release. Latch bar 26 can be withdrawn to release the latch by pulling cable 146 attached to lever 147 by a fitting 148 and confined within a sheath 149. Handle 150 is provided for actuation of the cable. The cable sheath 149 is attached to inside surface 48 by a clamp such as 151. When cable 146 is pulled, lever 147 is rotated counterclockwise about its fulcrum 152 attached to inside surface 48 of the latch frame. Lever 147 is pivotally attached to latch bar 26, so the rotation of lever 147 pulls latch bar 26 to the right, releasing cam 22 to allow it to return to its disengaged position. When handle 150 is then released, the spring 28 biased against latch bar 26 returns cable 146 to its original position. The embodiment shown in FIG. 11 normally does not require a lock if handle 150 is in a secure location such as the passenger compartment of a vehicle.

Since in this embodiment no other structure is provided to limit the travel of latch bar 26 to the left, a stop 153 is provided for that purpose.

I claim:

1. A rotary latch mechanism for engaging a latch post, comprising:

A. a cam pivotally mounted for rotation between engaged and disengaged positions about an axis parallel to the direction of extension of said latch post, said cam having peripheral edges and first and second parallel faces;

B. first biasing means to bias said cam toward said disengaged position at all times;

C. a first recess, defined by first opposed outwardly extending leading and following edges formed in said cam, to receive said post when said door is closed, wherein said leading edge clears said post to allow said post to enter said recess when said cam is in its disengaged position, said leading edge engages said post in said recess to latch said door when said cam is rotated to its engaged position, and said following edge engages said post in said recess as said door is closed to rotate said cam from its disengaged position to its engaged position;

D. a second recess, defined by second opposed outwardly extending leading and following edges formed in said cam;

E. a latch bar having first and second ends, disposed parallel to said axis, and mounted for sliding lengthwise between a retracted position clear of said cam, an intermediate position wherein said first end bears against the nearest face of said cam when said cam is in its disengaged position, and an extended position wherein said first end passes into said second recess and engages said second following edge to latch said cam in its engaged position;

F. second biasing means biasing said latch bar toward said extended position when said latch bar is free to slide;

G. unlatching means to retract said latch bar to said retracted position from said extended position, whereby to withdraw said first end from said second recess to free said cam for rotation to said disengaged position responsive to said first biasing means, and thus to release said latch post when said unlatching means is operated; and H. safety latch means to latch said cam in a safety position between its engaged and disengaged positions to permit rotation of said cam toward said engaged position and to prevent rotation of said cam toward said disengaged position, said safety latch means comprising a step formed in said nearest cam face adjacent said second following edge to receive said first end of said latching bar when said cam is in said safety position, and to clear said first end to allow extension of said latching bar when said cam is rotated to said engaged position.

2. The latch mechanism of claim 1, wherein said latch post is mounted on an inner edge of a door frame and said cam is mounted on a corresponding outer edge of a door.

3. The latch mechanism of claim 2, wherein said latch bar is mounted to said door and is positioned with said first end most nearly adjacent to said outer edge.

4. The latch mechanism of claim 3, wherein said latch bar, said cam, and said retracting means are each mounted on a rigid frame member for mounting in an aperture passing through the outer face of said door.

5. The latch mechanism of claim 1, wherein said unlatching means comprises:

A. a handle pivotally mounted at one end for rotation about a handle axis normal to the sliding direction of said latch bar;

B. a recess in said latch bar defined in part by a face opposed to the second end of said latch bar; and C. a tongue having a first end fixed to said handle, a second end extending into said latch bar recess, and a surface adjacent said opposed face;

whereby, when said handle is pivoted, said tongue surface engages said opposed face to push said latch bar to said retracted position against the bias of said second biasing means.

6. The latch mechanism of claim 1, wherein said unlatching means comprises a remote release including a cable to operate said latch bar, whereby actuation of said remote release pulls said cable, and thus pulls said latch bar toward its retracted position.

7. In the latch mechanism of claim 1, locking means engageable to prevent actuation of said unlatching means, comprising:

A. a locking bar having a first end pivoted for rotation about an axis normal to said latching bar and a second end having a first pivotal position clear of said latching bar and a second pivotal position whereby to engage said latching bar second end when said latching bar is in said extended position to prevent retraction thereof; and B. key-operated means to pivot said locking bar to either of said first and second pivotal positions.

8. The latch of claim 1, further comprising a frame to support said latch, wherein said unlatching means include a slot in the bar and a paddle handle pivoted on the frame and having an extension into said slot.

9. The latch of claim 1, further comprising a frame to support said latch, wherein said unlatching means include a flexible cable attached to said bar.

10. The latch of claim 1, further comprising a frame to support said latch, wherein said frame includes a bracket having a portion enclosing the sides of the latch bar to limit its movement to a linear path, said bracket having a semicylindrical pocket, said bar having a pocket under said bracket pocket, said latch bar bias means being a compression spring in said pockets.

* * * * *